US010932574B2

(12) United States Patent
Wang

(10) Patent No.: US 10,932,574 B2
(45) Date of Patent: Mar. 2, 2021

(54) ADJUSTABLE ARMREST

(71) Applicant: CHUAN HSING CHEMICAL INDUSTRY CO., LTD., Taichung (TW)

(72) Inventor: Ching-Chang Wang, Taichung (TW)

(73) Assignee: CHUAN HSING CHEMICAL INDUSTRY CO., LTD., Taichung (TW)

( * ) Notice: Subject to any disclaimer, the term of this patent is extended or adjusted under 35 U.S.C. 154(b) by 4 days.

(21) Appl. No.: 16/433,221

(22) Filed: Jun. 6, 2019

(65) Prior Publication Data

US 2020/0383486 A1 Dec. 10, 2020

(51) Int. Cl.
*A47C 7/54* (2006.01)

(52) U.S. Cl.
CPC ..... *A47C 7/541* (2018.08)

(58) Field of Classification Search
CPC ..... A47C 7/541; A47C 7/546; A47C 7/543; A47C 1/03; A47C 1/0307; A47C 1/0308
USPC ..... 297/411.32–411.34, 411.37–411.39
See application file for complete search history.

(56) References Cited

U.S. PATENT DOCUMENTS 6,059,366 A * 5/2000 Hu ..... B60N 2/75 297/411.35
6,203,109 B1 * 3/2001 Bergsten ..... A47B 21/0371 297/411.35
7,387,341 B1 * 6/2008 Tsai ..... A47C 1/03 297/411.35
8,474,914 B2 * 7/2013 Chen ..... A47C 1/03 297/411.37
9,044,098 B2 * 6/2015 Bauer ..... B60N 2/763
2003/0025378 A1 * 2/2003 Lin ..... A47C 7/54 297/411.35
2003/0178882 A1 * 9/2003 Schmitz ..... A47C 1/03277 297/411.36
2005/0189807 A1 * 9/2005 Norman ..... A47C 1/03 297/411.35
2006/0226691 A1 * 10/2006 Bedford ..... A47C 1/03 297/411.36
2008/0073965 A1 * 3/2008 Tsai ..... A47C 1/03 297/411.36
2011/0248543 A1 * 10/2011 Hitchcock ..... A47C 1/03 297/411.36
2012/0205958 A1 * 8/2012 Colasanti ..... A47C 1/03 297/411.36
2015/0130250 A1 * 5/2015 Masunaga ..... A47C 1/03 297/411.36

(Continued)

FOREIGN PATENT DOCUMENTS

TW 422032 U 2/2001

*Primary Examiner* — Mark R Wendell
(74) *Attorney, Agent, or Firm* — Alan D. Kamrath; Karin L. Williams; Mayer & Williams PC

(57) ABSTRACT

An adjustable armrest includes a post and an armrest body. A sliding member is coupled to the post and has a non-circular contour on a horizontal plane. The armrest body receives a sliding seat. The sliding seat includes a track extending in a length direction. The sliding member is received in the track. The armrest body is movable relative to the post. The track includes a first section and a second section interconnected to the first section. The first and second sections are arranged in the length direction. The first section extends along a rectilinear line. The second section extends along a non-rectilinear line.

8 Claims, 8 Drawing Sheets

(56) References Cited

U.S. PATENT DOCUMENTS

2019/0174921 A1* 6/2019 Chen ..... A47C 1/03

* cited by examiner

ADJUSTABLE ARMREST

BACKGROUND OF THE INVENTION

The present invention relates to an armrest device and, more particularly, to an adjustable armrest.

Taiwan Utility Model No. 422032 discloses a chair armrest swaying structure including a rectangular box-shaped sliding seat having two pegs respectively extending upwardly from two ends thereof. Each peg has a height the same as the height of the box and includes a central hole through which a screw extends for attachment to a bottom of an armrest. The sliding seat includes a central portion having a slot with an appropriate length for receiving a hexagonal block projecting upward from a central portion of a fixing seat. A bolt extends through a through-hole in a central portion of the hexagonal block and extends into the sliding seat. The bolt further extends through a circular disc and a resilient washer and is coupled with a clip. Thus, the sliding seat is slidable relative to the fixing seat in a front/rear direction and is pivotable leftward/rightward.

Although the sliding seat is slidable and pivotable in any location, when a user places his or her hand on the armrest, a force is imparted to the armrest, causing unexpected movement of the armrest due to the high degree of free movement. Inconvenience is caused during use.

Thus, a need exists for a novel adjustable armrest that mitigates and/or obviates the disadvantages of the conventional armrests.

BRIEF SUMMARY OF THE INVENTION

An objective of the present invention is to provide an adjustable armrest including a post and an armrest body. A sliding member is coupled to the post and has a non-circular contour on a horizontal plane. The armrest body receives a sliding seat. The sliding seat includes a track extending in a length direction. The sliding member is received in the track. The armrest body is movable relative to the post. The track includes a first section and a second section interconnected to the first section. The first and second sections are arranged in the length direction. The first section extends along a rectilinear line. The second section extends along a non-rectilinear line.

In an example, the armrest body includes a front end and a rear end spaced from the front end in the length direction. The first section extends from a location of the sliding seat adjacent to the front end towards the rear end. The second section is connected to an end of the first section adjacent to the rear end.

In an example, the armrest body includes an outer side and an inner side spaced from the outer side in a width direction perpendicular to the length direction. The second section extends along an arcuate line having a circle center located on a side of the track adjacent to the inner side.

In an example, the sliding member is connected to an end of the post and includes a first narrower portion and a first wider portion. The first wider portion is located on a side of the sliding member adjacent to the post. The first wider portion is located on a side of the first narrower portion distant from the post. The first narrower portion has a width in the width direction smaller than a width of the first wider portion in the width direction. The track includes a second narrower portion and a second wider portion. The second narrower portion and the second wider portion are arranged in a vertical direction perpendicular to the length direction and the width direction. The first narrower portion is disposed in the second narrower portion. The first wider portion is disposed in the second wider portion. A width of the second narrower portion in the width direction is smaller than a width of the second wider portion in the width direction and is smaller than the width of the first wider portion in the width direction.

In an example, a buffering member is mounted on the sliding member, is annular, and is resilient. The buffering member is mounted around an outer periphery of the first wider portion. A side of the buffering member distant from the sliding member abuts an inner periphery of the second wider portion.

In an example, an end of the first wider portion adjacent to the front end includes a peripheral edge having semi-circular cross sections. Another end of the first wider portion adjacent to the rear end includes a peripheral edge having semi-circular cross sections. A side of the first wider portion adjacent to the outer side includes a first groove. Another side of the first wider portion adjacent to the inner side includes a second groove. The buffering member does not contact with inner walls of the first groove and the second groove.

In an example, the second narrower portion includes a first inner edge located adjacent to the outer side. A first projection projects from the first inner edge of the second narrower portion. The second narrower portion further includes a second inner edge located adjacent to the inner side. A second projection projects from the second inner edge of the second narrower portion. A spacing between the first projection and the second projection is smaller than the width of the second narrower portion in the width direction.

In an example, the spacing is not larger than 10 mm.

In an example, two fasteners extend from a side of the sliding member distant from the post through the sliding member and are threadedly coupled to the post, fixing the sliding member to the post.

In an example, the armrest body includes a pad disposed on a side of the sliding seat distant from the post.

The present invention will become clearer in light of the following detailed description of illustrative embodiments of this invention described in connection with the drawings.

DETAILED DESCRIPTION OF THE INVENTION

Figure 1:
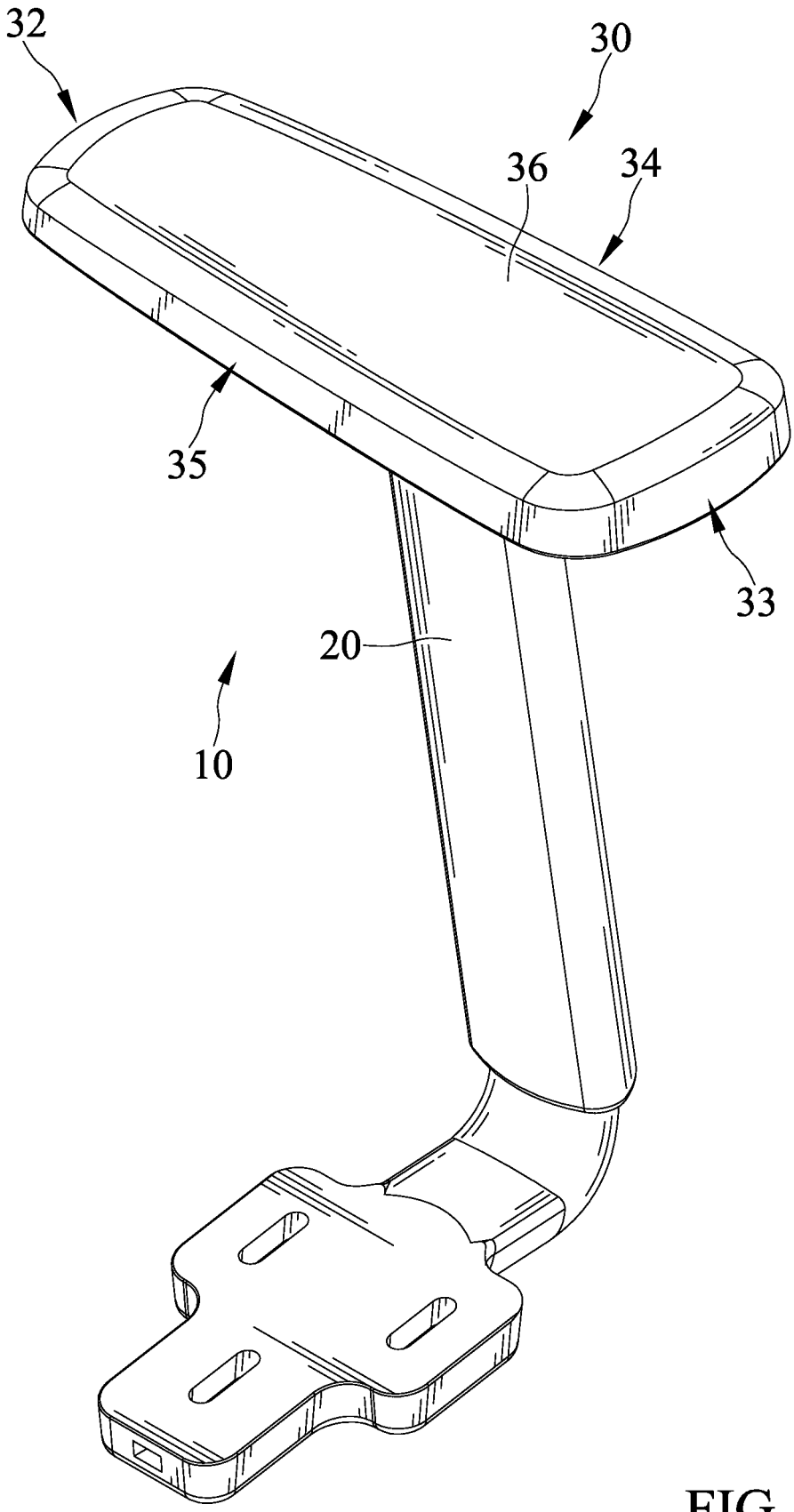
FIG. 1 is a perspective view of an adjustable armrest of an embodiment according to the present invention.
Figure 2:
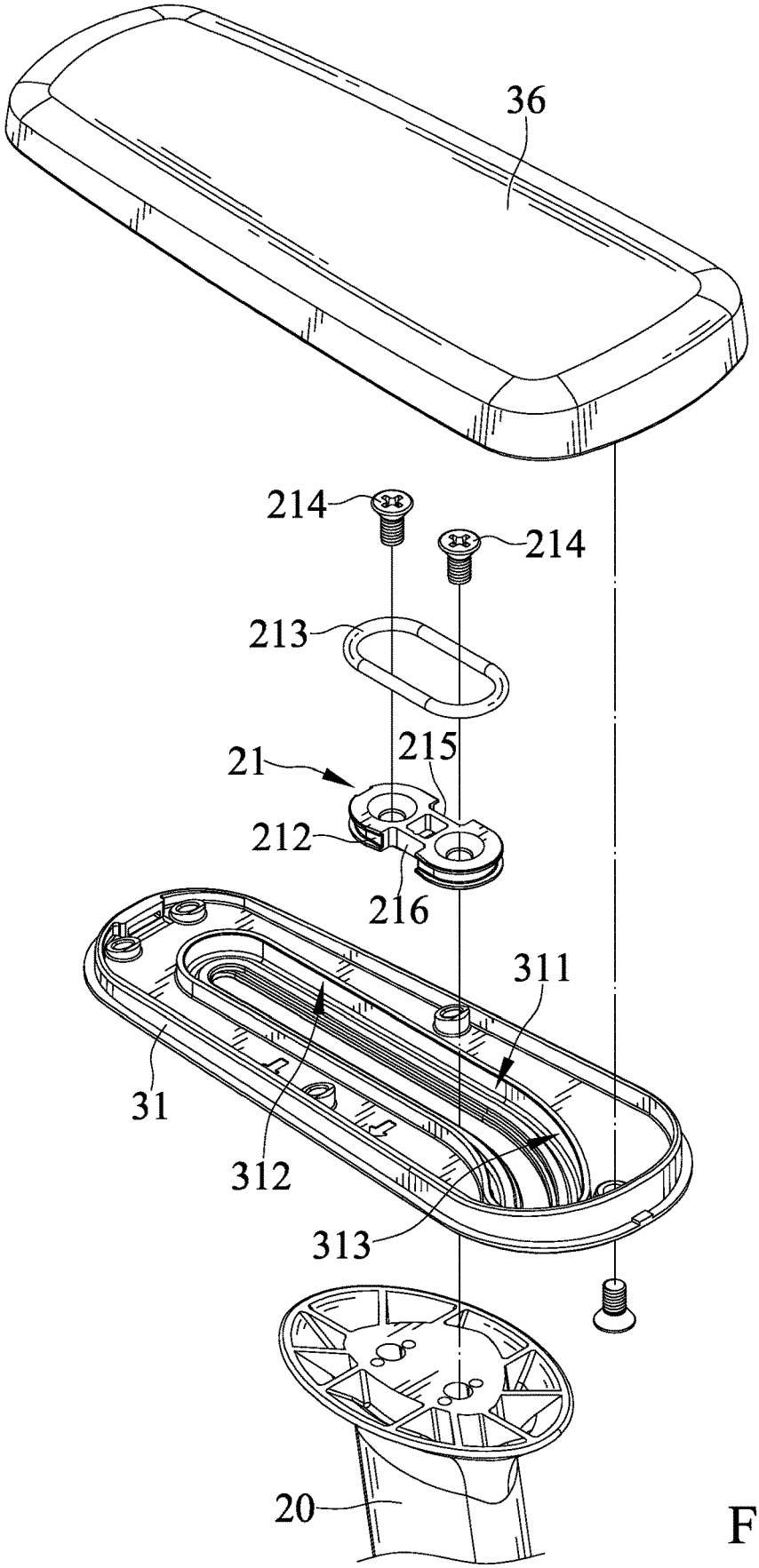
FIG. 2 is a partial, exploded, perspective view of the adjustable armrest of FIG. 1.
Figure 3:
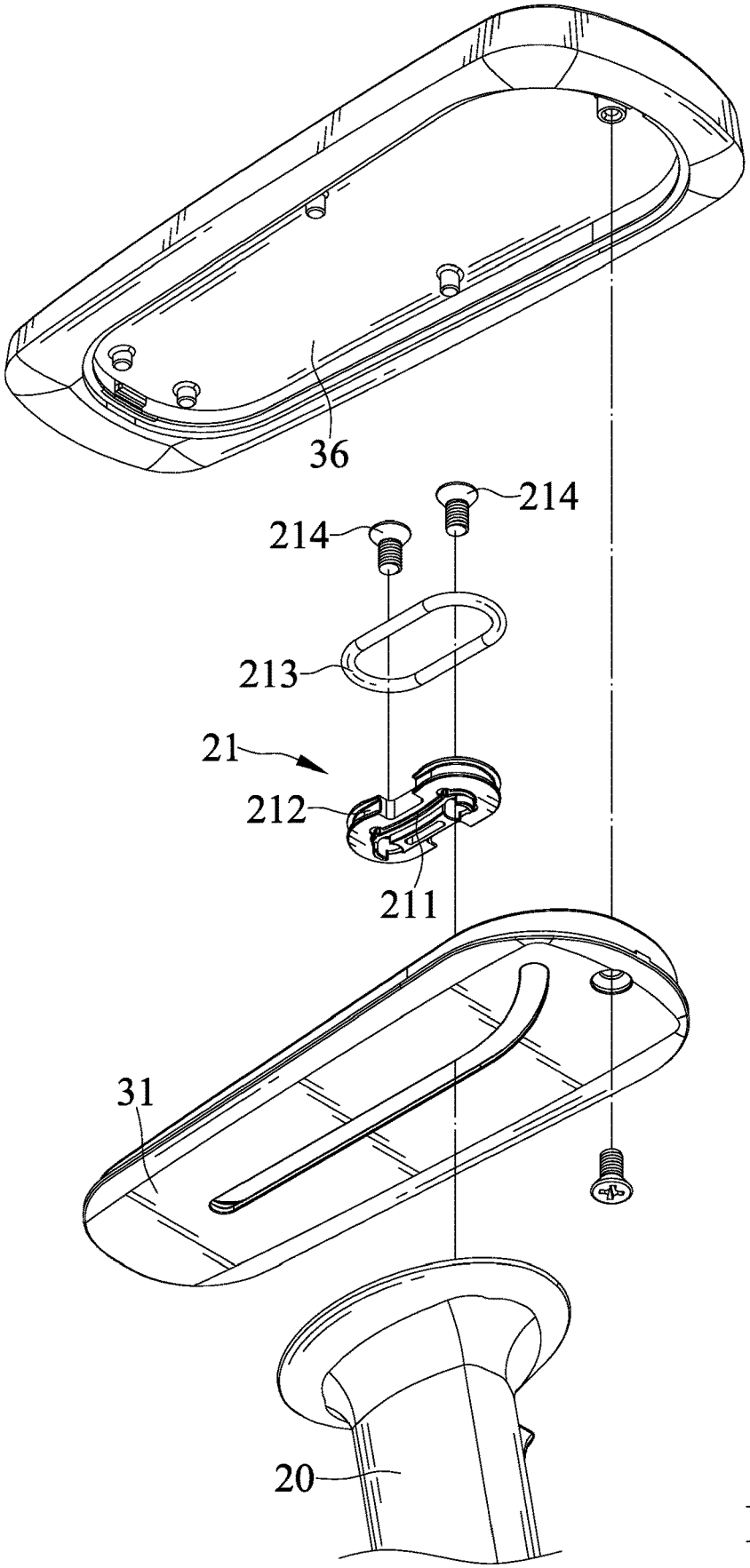
FIG. 3 is another partial, exploded, perspective view of the adjustable armrest of FIG. 1.
Figure 4:
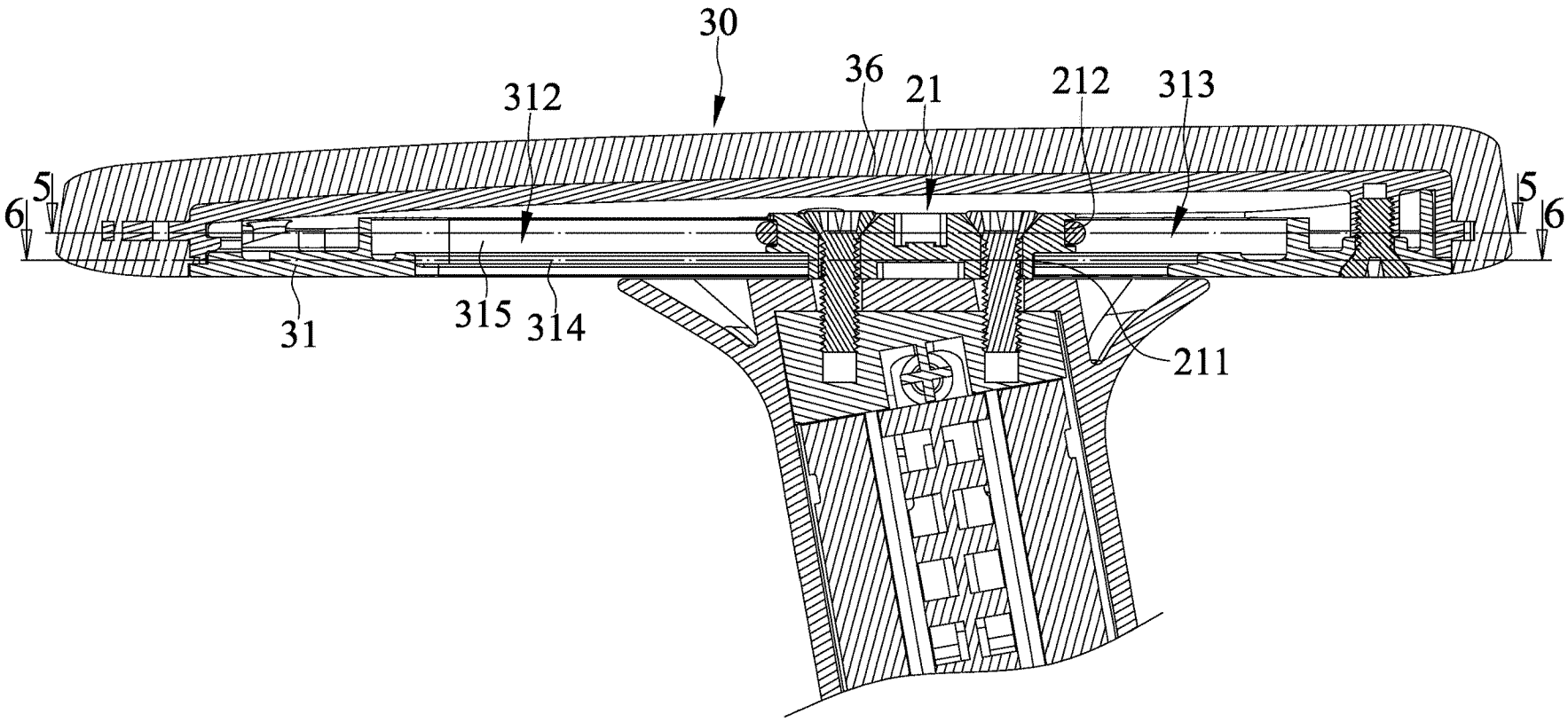
FIG. 4 is a cross sectional view of the adjustable armrest of FIG. 1.
Figure 5:
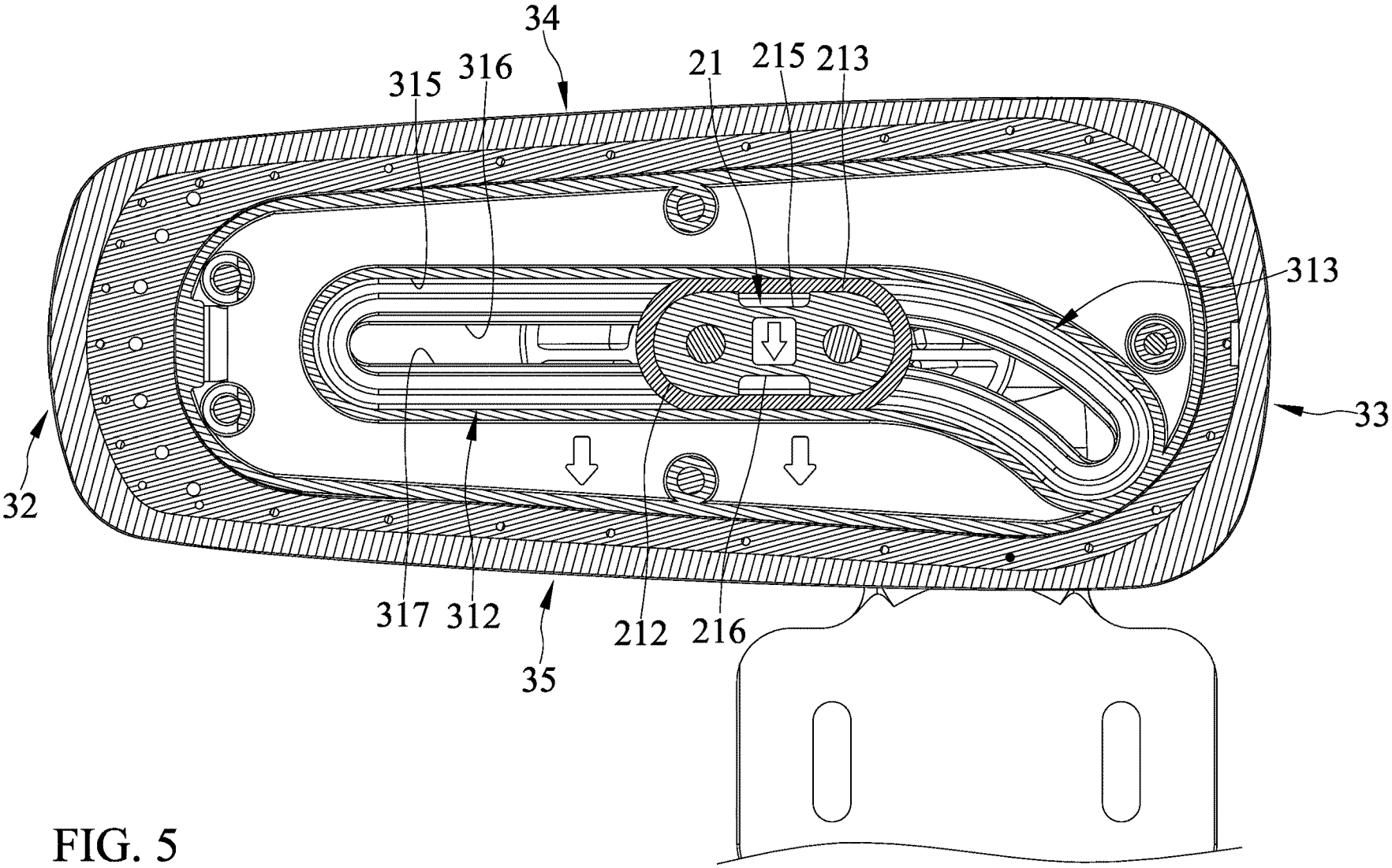
FIG. 5 is a cross sectional view taken along section line 5-5 of FIG. 4, with a sliding member located at a first section of a track.
Figure 6:
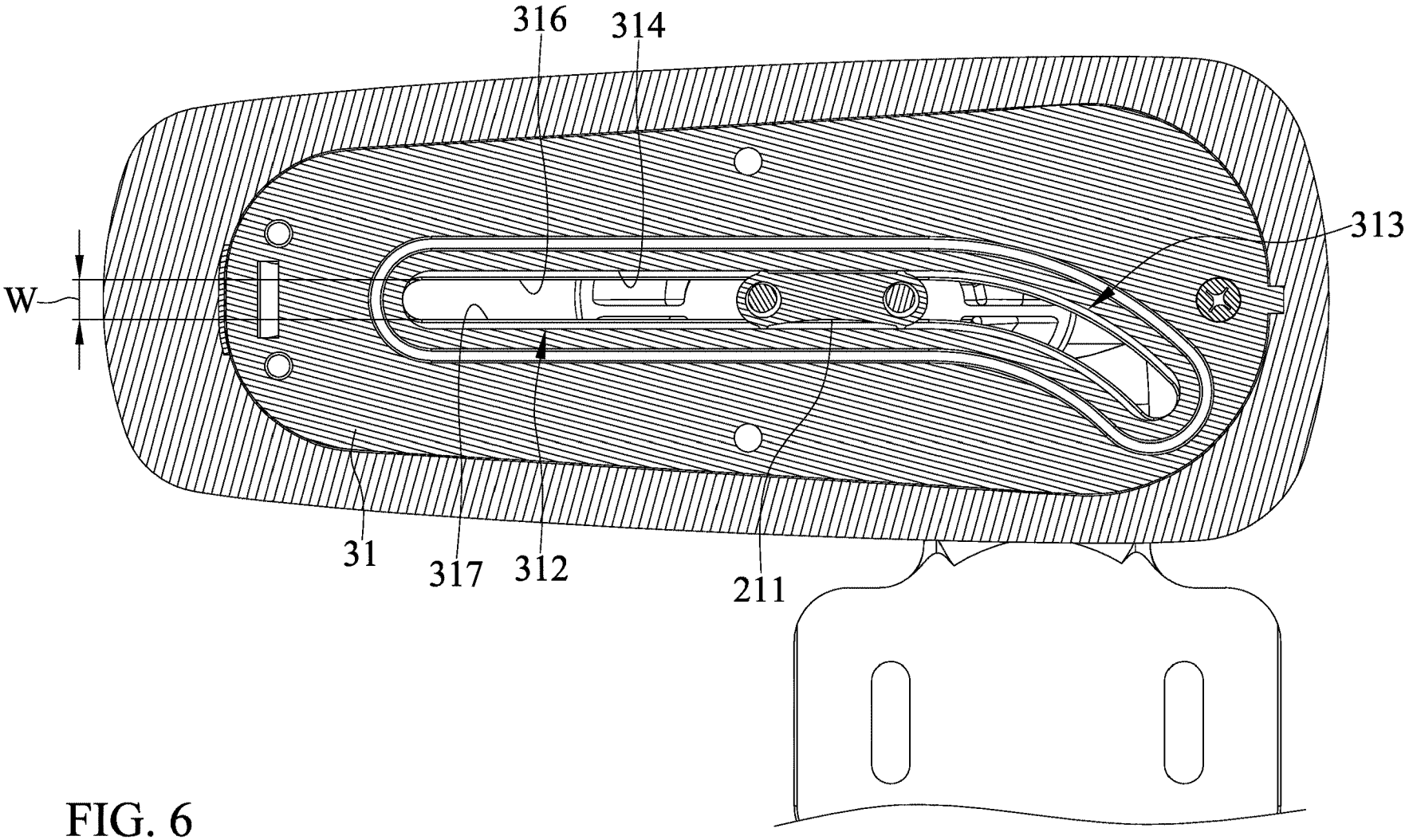
FIG. 6 is a cross sectional view taken along section line 6-6 of FIG. 4, with the sliding member located at the first section of the track.
Figure 7:
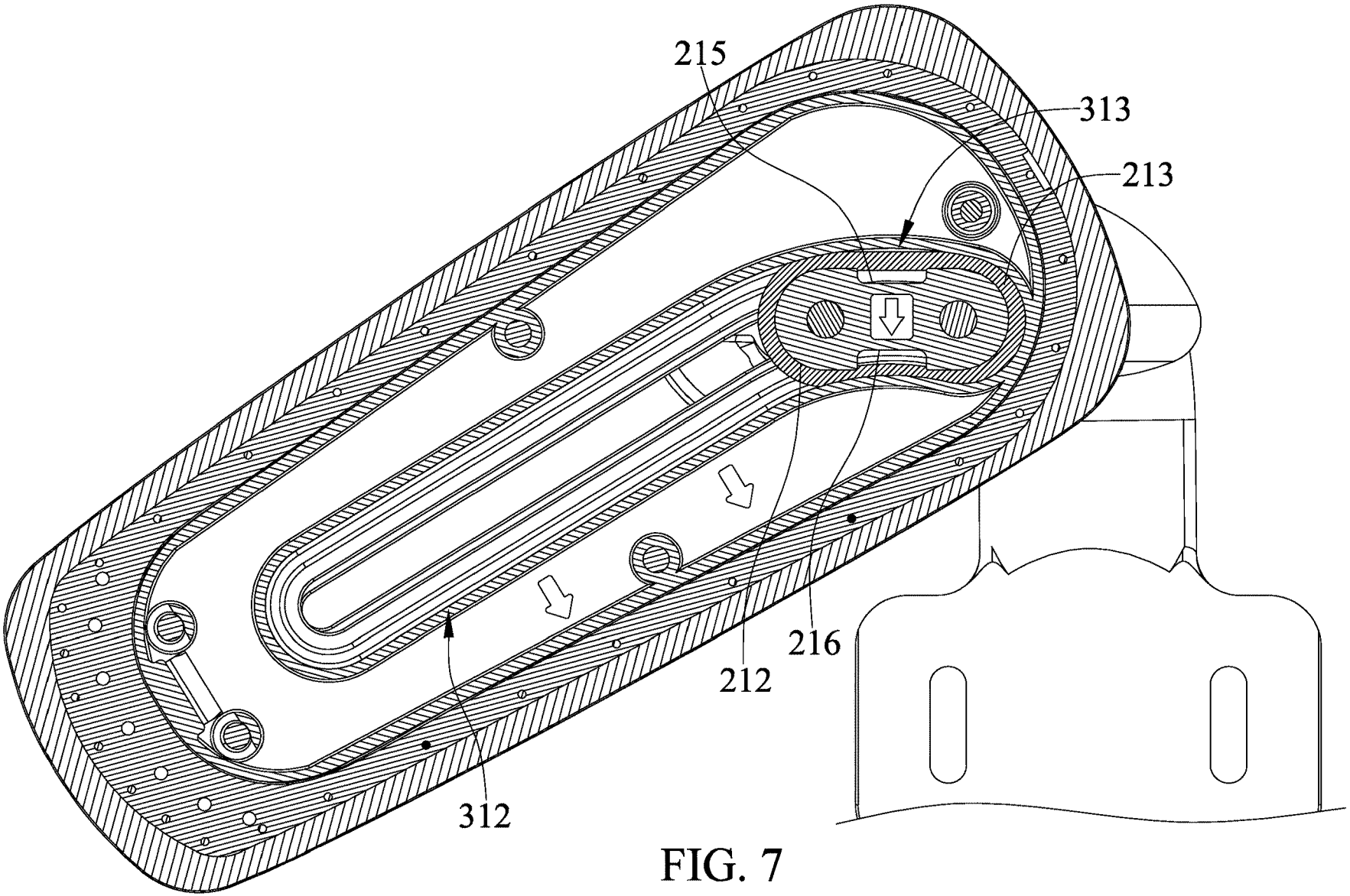
FIG. 7 is a cross sectional similar to FIG. 5, with the sliding member located at the second section of the track.
Figure 8:
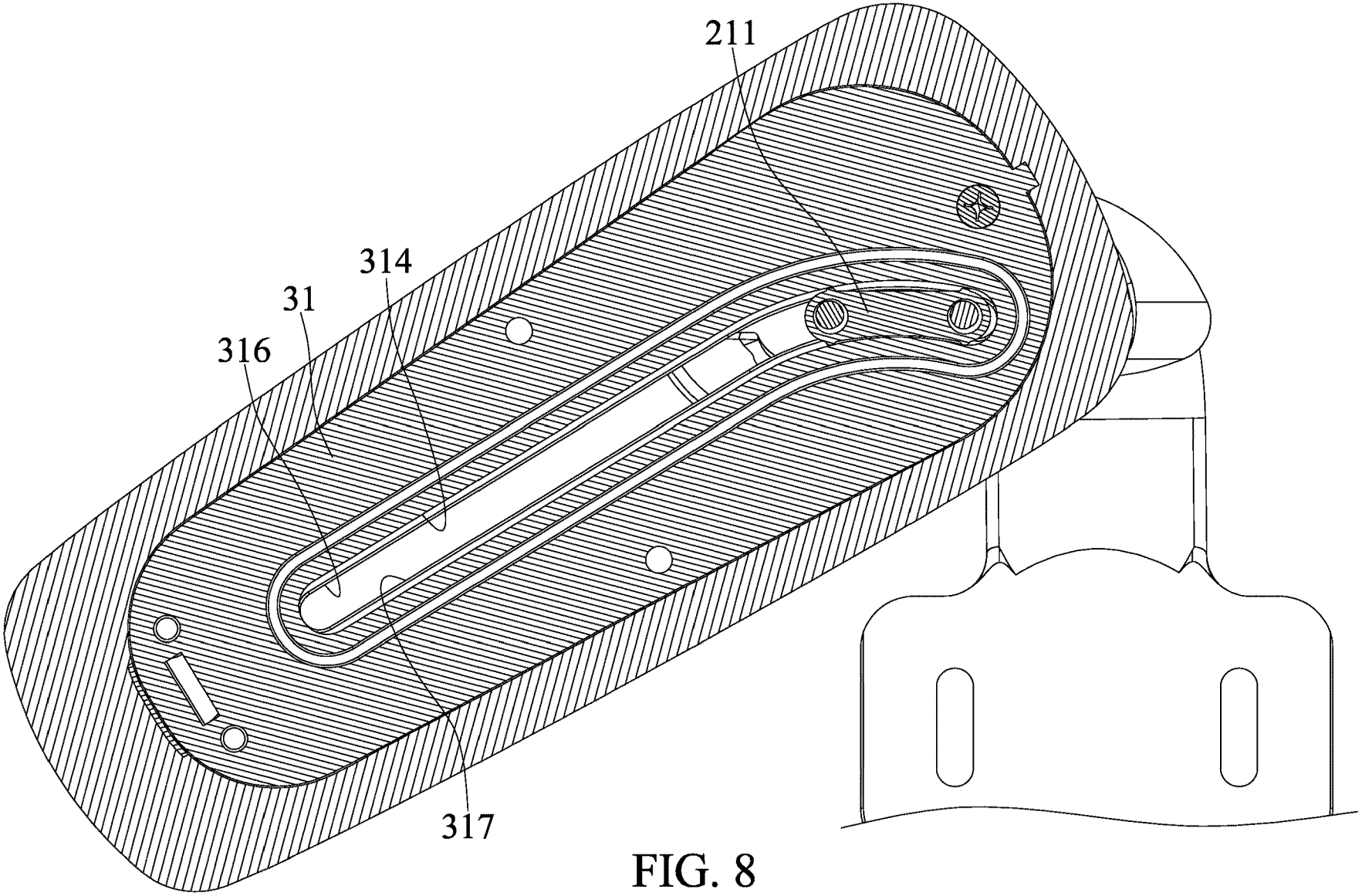
FIG. 8 is a cross sectional view similar to FIG. 6, with the sliding member located at the second section of the track.

With reference to FIGS. 1-8, an adjustable armrest 10 of an embodiment according to the present invention includes a post 20 and an armrest body 30. A sliding member 21 is coupled to the post 20 and has a non-circular contour on a horizontal plane. In this embodiment, the sliding member 21 is connected to an end of the post 20 and includes a first narrower portion 211 and a first wider portion 212. The first wider portion 212 is located on a side of the sliding member 21 adjacent to the post 20. The first wider portion 212 is located on a side of the first narrower portion 211 distant from the post 20. The first narrower portion 211 has a width in a width direction smaller than a width of the first wider portion 212 in the width direction.

A buffering member 213 is mounted on the sliding member 21, is annular, and is resilient. The buffering member 213 is mounted around an outer periphery of the first wider portion 212.

Two fasteners 24 extend from a side of the sliding member 21 distant from the post 20 through the sliding member 21 and are threadedly coupled to the post 20, fixing the sliding member 21 to the post 20.

The armrest body 30 receives a sliding seat 31 having a track 311 extending in a length direction perpendicular to the width direction. The sliding member 21 is received in the track 311. The armrest body 30 is movable relative to the post 20. The track 311 includes a first section 312 and a second section 313 interconnected to the first section 312. The first and second sections 312 and 313 are arranged in the length direction. The first section 312 extends along a rectilinear line. The second section 313 extends along a non-rectilinear line.

The track 311 includes a second narrower portion 314 and a second wider portion 315. The second narrower portion 314 and the second wider portion 315 are arranged in a vertical direction perpendicular to the length direction and the width direction. The first narrower portion 211 is disposed in the second narrower portion 314. The first wider portion 212 is disposed in the second wider portion 315. A width of the second narrower portion 314 in the width direction is smaller than a width of the second wider portion 315 in the width direction and is smaller than the width of the first wider portion 212 in the width direction. A side of the buffering member 213 distant from the sliding member 21 abuts an inner periphery of the second wider portion 315.

The armrest body 30 includes a front end 32 and a rear end 33 spaced from the front end 32 in the length direction. The first section 312 extends from a location of the sliding seat 31 adjacent to the front end 32 towards the rear end 33. The second section 313 is connected to an end of the first section 312 adjacent to the rear end 33.

The armrest body 30 includes an outer side 34 and an inner side 35 spaced from the outer side 34 in the width direction perpendicular to the length direction. The second section 313 extends along an arcuate line having a circle center located on a side of the track 311 adjacent to the inner side 35.

The second narrower portion 314 includes a first inner edge located adjacent to the outer side 34. A first projection 316 projects from the first inner edge of the second narrower portion 314. The second narrower portion 314 further includes a second inner edge located adjacent to the inner side 35. A second projection 317 projects from the second inner edge of the second narrower portion 314. A spacing W between the first projection 316 and the second projection 317 is smaller than the width of the second narrower portion 314 in the width direction.

An end of the first wider portion 212 adjacent to the front end 32 includes a peripheral edge having semi-circular cross sections. Another end of the first wider portion 212 adjacent to the rear end 33 includes a peripheral edge having semi-circular cross sections. A side of the first wider portion 212 adjacent to the outer side 34 includes a first groove 215. Another side of the first wider portion 212 adjacent to the inner side 35 includes a second groove 216. The buffering member 213 does not contact with inner walls of the first groove 215 and the second groove 216.

The armrest body 30 includes a pad 36 disposed on a side of the sliding seat 31 distant from the post 20.

By providing the above structure, the armrest body 30 can move in the length direction and can pivot to change its angular position. When the sliding member 21 is located in the first section 312, the armrest body 30 can move relative to the post 20 in the length direction to adjust its position in the length direction. When the sliding member 21 is located in the second section 313, the armrest body 30 can move in the length direction and can pivot in a direction toward the inner side 35 at the same time. When the armrest body 30 moves to its frontmost position, the armrest body 30 is ahead of a user and, thus can support the elbow of the user using a keyboard, reducing the burden to the elbow.

Although specific embodiments have been illustrated and described, numerous modifications and variations are still possible without departing from the scope of the invention. The scope of the invention is limited by the accompanying claims.

The invention claimed is:

1. An adjustable armrest comprising:

a post and a sliding member coupled to the post, wherein the sliding member has a non-circular contour on a horizontal plane; and an armrest body receiving a sliding seat, wherein the sliding seat includes a track extending in a length direction, wherein the sliding member is received in the track, wherein the armrest body is movable relative to the post, wherein the track includes a first section and a second section interconnected to the first section, wherein the first and second sections are arranged in the length direction, wherein the first section extends along a rectilinear line, and wherein the second section extends along a non-rectilinear line;

wherein the armrest body includes a front end and a rear end spaced from the front end in the length direction, wherein the first section extends from a location of the sliding seat adjacent to the front end towards the rear end, and wherein the second section is connected to an end of the first section adjacent to the rear end;

wherein the armrest body includes an outer side and an inner side spaced from the outer side in a width direction perpendicular to the length direction, wherein the second section extends along an arcuate line having a circle center located on a side of the track adjacent to the inner side.

2. The adjustable armrest as claimed in claim 1, wherein the sliding member is connected to an end of the post and includes a first narrower portion and a first wider portion, wherein the first wider portion is located on a side of the sliding member adjacent to the post, wherein the first wider portion is located on a side of the first narrower portion distant from the post, wherein the first narrower portion has a width in the width direction smaller than a width of the first wider portion in the width direction, wherein the track includes a second narrower portion and a second wider portion, wherein the second narrower portion and the second wider portion are arranged in a vertical direction perpendicular to the length direction and the width direction, wherein the first narrower portion is disposed in the second narrower portion, wherein the first wider portion is disposed in the second wider portion, wherein a width of the second narrower portion in the width direction is smaller than a width of the second wider portion in the width direction and is smaller than the width of the first wider portion in the width direction.

3. The adjustable armrest as claimed in claim 2, wherein a buffering member is mounted on the sliding member, is annular, and is resilient, wherein the buffering member is mounted around an outer periphery of the first wider portion, and wherein a side of the buffering member distant from the sliding member abuts an inner periphery of the second wider portion.

4. The adjustable armrest as claimed in claim 3, wherein an end of the first wider portion adjacent to the front end includes a peripheral edge having semi-circular cross sections, wherein another end of the first wider portion adjacent to the rear end includes a peripheral edge having semi-circular cross sections, wherein a side of the first wider portion adjacent to the outer side includes a first groove, wherein another side of the first wider portion adjacent to the inner side includes a second groove, and wherein the buffering member does not contact with inner walls of the first groove and the second groove.

5. The adjustable armrest as claimed in claim 4, wherein the second narrower portion includes a first inner edge located adjacent to the outer side, wherein a first projection projects from the first inner edge of the second narrower portion, wherein the second narrower portion further includes a second inner edge located adjacent to the inner side, wherein a second projection projects from the second inner edge of the second narrower portion, and wherein a spacing between the first projection and the second projection is smaller than the width of the second narrower portion in the width direction.

6. The adjustable armrest as claimed in claim 5, wherein the spacing is not larger than 10 mm.

7. The adjustable armrest as claimed in claim 6, wherein two fasteners extend from a side of the sliding member distant from the post through the sliding member and are threadedly coupled to the post, fixing the sliding member to the post.

8. The adjustable armrest as claimed in claim 7, wherein the armrest body includes a pad disposed on a side of the sliding seat distant from the post.

* * * * *